US007192049B2

(12) United States Patent
Kuerten et al.

(10) Patent No.: US 7,192,049 B2
(45) Date of Patent: Mar. 20, 2007

(54) MACHINE WITH HOISTING MECHANISM

(75) Inventors: Hans-Werner Kuerten, Goedenroth (DE); Joachim Ponstein, Gondershausen (DE); Herbert Roos, Hungenroth (DE); Thomas Weiler, Oberwesel (DE)

(73) Assignee: Bomag GmbH, Boppard (DE)

( * ) Notice: Subject to any disclaimer, the term of this patent is extended or adjusted under 35 U.S.C. 154(b) by 119 days.

(21) Appl. No.: 11/087,817

(22) Filed: Mar. 24, 2005

(65) Prior Publication Data

US 2005/0232739 A1 Oct. 20, 2005

(30) Foreign Application Priority Data

Mar. 25, 2004 (DE) ..... 20 2004 004 706 U

(51) Int. Cl.
*B66C 1/20* (2006.01)

(52) U.S. Cl. ..... 280/727; 294/68.1; 294/74; 294/68.3

(58) Field of Classification Search ..... 294/74, 294/86.4, 68.1, 68.3, 67.4, 82.1, 82.11, 82.12; 212/294; 224/400, 401, 549, 555; 280/727
See application file for complete search history.

(56) References Cited

U.S. PATENT DOCUMENTS 5,263,687 A * 11/1993 Garbiso ..... 254/334
6,232,576 B1 * 5/2001 Bankstahl ..... 219/133

* cited by examiner

*Primary Examiner*—Paul N. Dickson
*Assistant Examiner*—Timothy Wilhelm
(74) *Attorney, Agent, or Firm*—Baker & Hostetler LLP

(57) ABSTRACT

The invention relates to a machine, particularly a construction machine, with a hoisting mechanism for hoisting the machine with the aid of a hoisting apparatus, whereby the hoisting mechanism comprises a flexible bearing element, one end of which is fastened in the region of the horizontal center of gravity of the machine, and the other end of which comprises a suspension capability for connecting to the hoisting apparatus.

17 Claims, 7 Drawing Sheets

MACHINE WITH HOISTING MECHANISM

CROSS REFERENCE TO RELATED APPLICATIONS

This application claims priority to German Patent Application Serial No. 202004004706.3, filed Mar. 25, 2004 titled, MACHINE WITH LIFTING DEVICE, the disclosure of which is incorporated by reference in its entirety.

FIELD OF THE INVENTION

The invention relates to a machine, particularly a construction machine, that can be hoisted with the aid of a hoisting mechanism for loading and unloading purposes.

BACKGROUND OF THE INVENTION

Construction equipment in particular is poorly suited to traveling long distances on its own to and from the place where it is used. For this reason it is usually loaded onto transport vehicles and moved to the site. In order to unload the equipment from the transport vehicle, it can be hoisted from the transport vehicle and placed on the ground by means of a hoisting device such as a crane.

This requires a suitable connection between the construction machine and the hoist. Care must be taken that the machine does not tip or swing when being hoisted in order to avoid damaging the machine during the hoisting or lowering processes or damaging the transport vehicle during the loading or unloading processes.

Furthermore, a mechanism at the machine that serves to produce the connection between the hoisting apparatus and the machine should not cause a disturbance during the normal operation of the machine, for instance by rattling, and should be invisible if possible.

SUMMARY OF THE INVENTION

The object of the invention is to make available a machine that can be easily connected to a hoist, whereby the mechanism disturbs the user of the machine as little as possible.

This object is achieved by a hoisting mechanism according to claim 1.

Advantageous developments of the invention are provided in the subclaims.

According to the invention, a machine is provided with a hoisting mechanism for hoisting the machine by means of a hoisting apparatus. The hoisting mechanism comprises a flexible bearing element that is fastened at one end in the region of the horizontal center of gravity of the machine and on the other end comprises a suspension element for connection to the hoisting apparatus.

The advantage of utilizing a flexible bearing element as the hoist is that the flexible bearing element can easily be moved into different positions depending on use or nonuse. Further benefit is gained when the hoisting mechanism is not rigidly fixed to the machine, which can lead to difficulties if the horizontal center of gravity shifts. Furthermore, expensive steel constructions for the connection to the hoisting mechanism are avoided by the provision of the flexible bearing.

According to a further embodiment, it may be provided that the flexible bearing element is displaceably guided by an elongated guide element that is disposed above the horizontal center of gravity substantially vertically.

The guide element can comprise an outwardly curved portion at least at one end in order to reduce abrasion of the flexible bearing element that is led through the guide element.

According to a preferred embodiment, it may be provided that an inner cross-section of the guide element is so adapted to a cross-sectional shape of the flexible bearing element, that the flexible bearing element does not rotate in the guide element. That way, the machine is prevented from rotating when suspended at the hoist.

The flexible bearing element can be movable into a neutral position in which the guide element is shifted in the direction of the center of gravity until the suspension element is located close to a top end of the guide element. In a working position in which the flexible bearing element is drawn upward, it extends from the center of gravity through the guide element substantially in a stretched condition.

The benefit therein is that in the neutral position the bearing element is located substantially in an intermediate space between the center of gravity and the guide element, and as a result it does not disturb the user of the machine.

The suspension element can be constructed as a bracket, grommet, or hook, whereby the bracket is held at the flexible bearing element, the retaining mechanism being located near the top end of the guide element so that it can hold the suspension mechanism in the neutral position.

In a further embodiment of the invention, it may be provided that the retainer is constructed in such a way that in the neutral position it holds the suspension mechanism within it in a downwardly pivoted condition. This serves to fix the suspension mechanism and to prevent vibrations so as to prevent damage to the surrounding components.

The retainer can be covered by means of a cover, so that the suspension element can be covered when it is held in the retainer in neutral position and can be removed from the retainer in order to switch into working position.

The hoisting mechanism can further comprise a retaining fixture attached at the horizontal center of gravity of the machine, whereby the flexible bearing element comprises a loop at one end, and the retaining fixture comprises two eyes through which a bolt can be inserted so that the bolt runs through the loop. That way, a secure connection between the hoisting apparatus and the flexible bearing element is guaranteed, whereby the connection can be broken by removing the bolt, so that the flexible bearing element can be easily replaced, for instance if it is old and/or brittle.

The flexible bearing element can advantageously take the form of a band. Furthermore, it can be corrosion-resistant, comprising a plastic or composite fiber material.

BRIEF DESCRIPTION OF THE DRAWINGS

Preferred exemplifying embodiments of the invention will now be described in connection with schematic drawings. Shown are.

DETAILED DESCRIPTION

Figure 1:
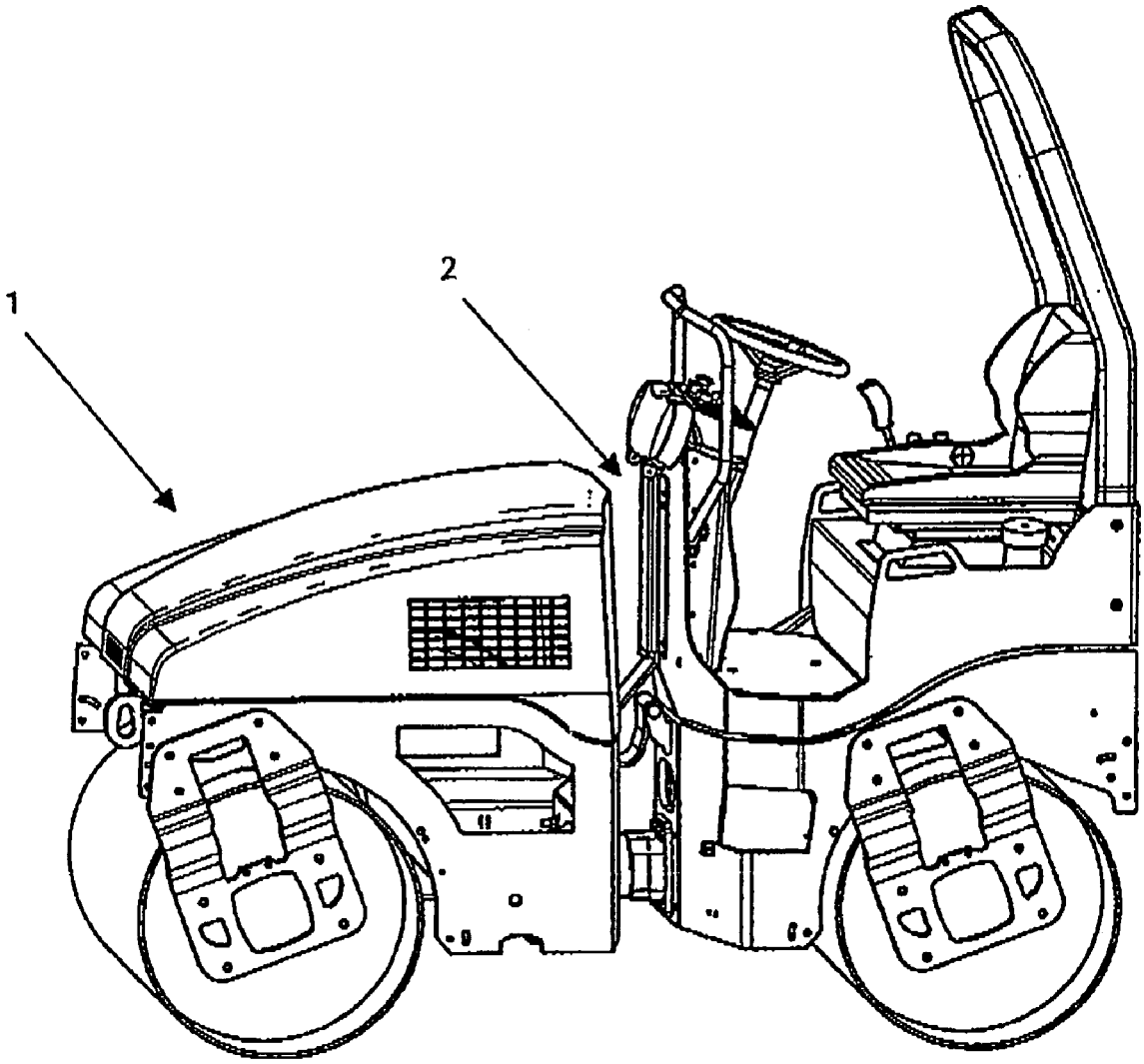
FIG. 1: a general view of a machine with a hoisting mechanism according to a preferred embodiment of the invention.

FIG. 1 represents a construction machine 1, particularly a compression machine, comprising a hoisting mechanism 2 that is disposed substantially at the position of a horizontal center of gravity of the machine 1. The hoisting mechanism serves for hoisting the machine 1 with the aid of a crane or other hoisting apparatus in order to load the machine onto a transport vehicle or unload it therefrom. To that end the hoisting mechanism 2 is connected to the hoisting apparatus (not represented) and can be hoisted by it.

The provision of the hoisting mechanism 2 at the substantially horizontal center of gravity of the construction machine 1 serves for preventing the machine from tipping when hoisted.

Figure 2:
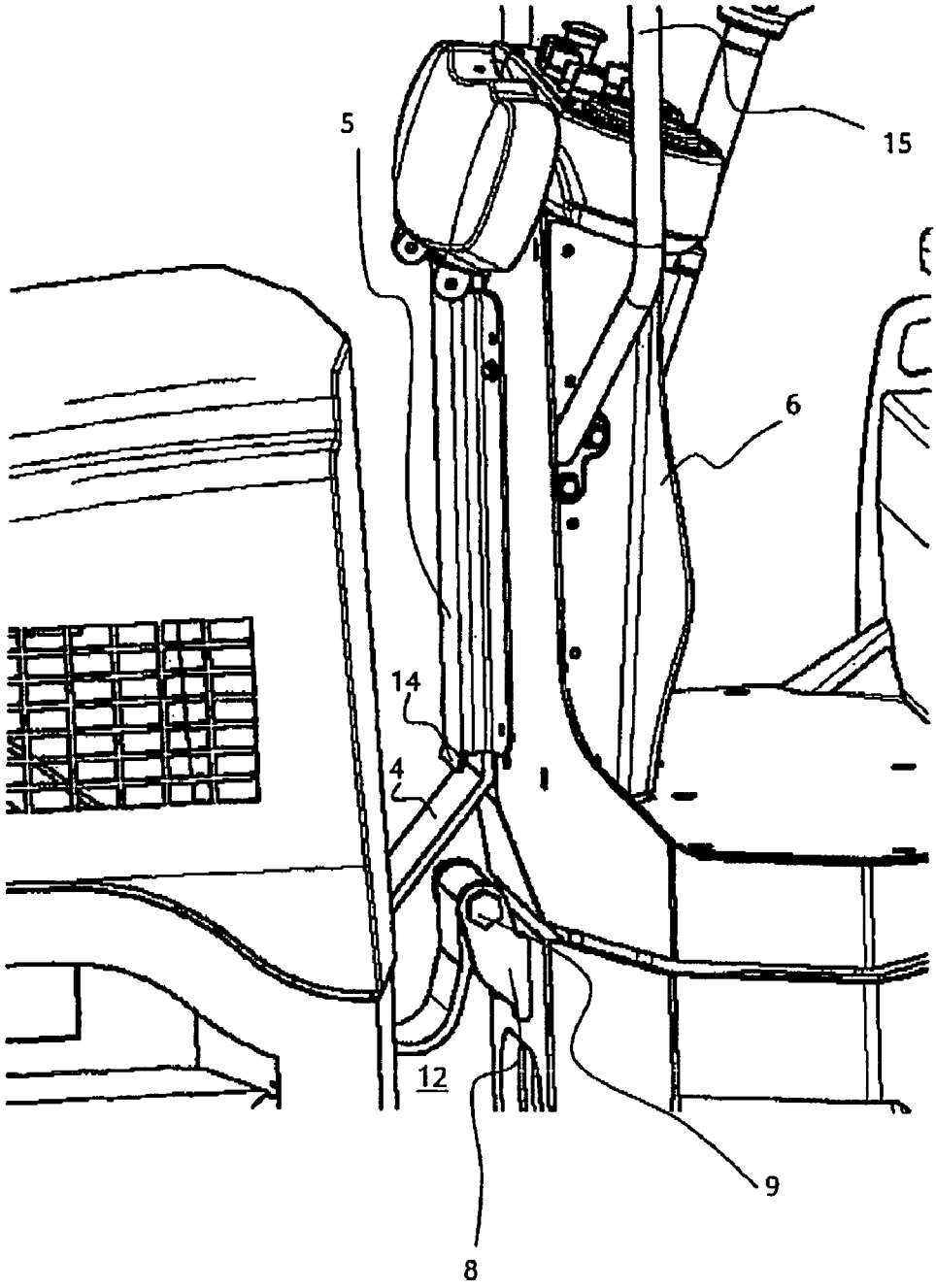
FIG. 2: an enlarged view of part of the machine with the hoisting mechanism in neutral position.

FIG. 2 is an enlarged view of the hoisting mechanism 2 in a neutral position. The hoisting mechanism 2 comprises a flexible bearing element 4 in the form of a flexible band with a rectangular cross-section. Other cross-sections are possible for the band or other bearing element 4. The flexible band 4 is led through a guide element 5 in the form of a channel which is fastened to a column with a control console 6 of the machine. The channel is formed by a sheet-metal tube in this case. A climbing bracket 15 is also provided at the column.

At a bottom end the flexible band 4 is provided with a loop 7 which is held at a retaining fixture 8. The retaining fixture 8 comprises two retainer elements that are fixed to the machine, through which a bolt 9 can be inserted such that the bolt extends through the loop. This guarantees a secure but detachable connection between the flexible band 4 and the machine 1.

The guide element 5 is attached substantially vertically over the retaining fixture, so that in the suspended condition the flexible band 4 extends from the retaining fixture 8 through the guide element 5 substantially in a straight line.

Figure 3:
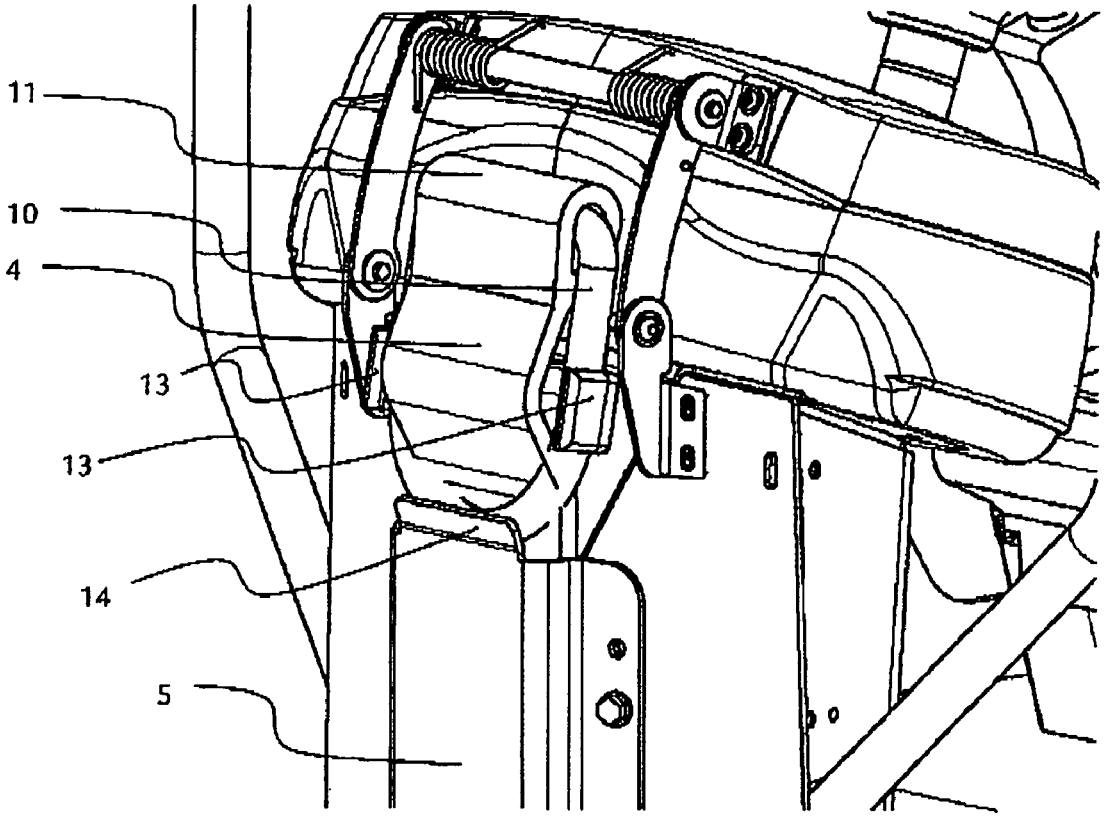
FIG. 3: a view of the suspension element that is fixed in a retainer.

FIG. 3 represents a top end of the flexible band 4 in a neutral position. The top end of the flexible band 4 is provided with a bracket 10 that is connected to an additional loop 11 of the flexible band 4. A grommet, hook or other suspension element can be provided instead of the bracket 10, provided it is suitable for producing a connection to the hoisting apparatus.

In the neutral position the flexible band 4 is pushed down through the guide element 5, so that in the non-stretched condition the flexible band 4 can be located in an intermediate space 12 of the machine between a bottom end of the guide element 5 and the retaining fixture 8. In the neutral state the bracket 10 is folded down into a direction parallel to the flexible band 4 and inserted into a retainer 13 so that the bracket 10 is held securely against vibrations and will not fall out.

The retainer 13 is constructed as a retaining clamp with two turned ends that, when in the fixed condition, hold the bracket 10 against lateral displacement. When the bracket 10 is in the folded condition, its lower end makes contact with an upper end of the guide element 5, so that the bracket 10 cannot fall downward and out of the retaining clamp 13.

As shown in FIG. 2 and FIG. 3, the guide element 5 comprises turned sections 14 at both ends in order to prevent the band 4 from getting caught at the guide element 5 or being abraded at the guide element when the flexible band 4 is pushed through the guide element 5.

The guide element 5 is constructed so that its inner cross-section is substantially adapted to the cross-section of the flexible band 4. Because the flexible band 4 has a rectangular cross-section, the cross-section of the guide element 5 is expediently also rectangular, which enables the flexible band 4 to be drawn freely through the guide element 5 while preventing twisting of the band 4 in the guide element 5.

Figure 4:
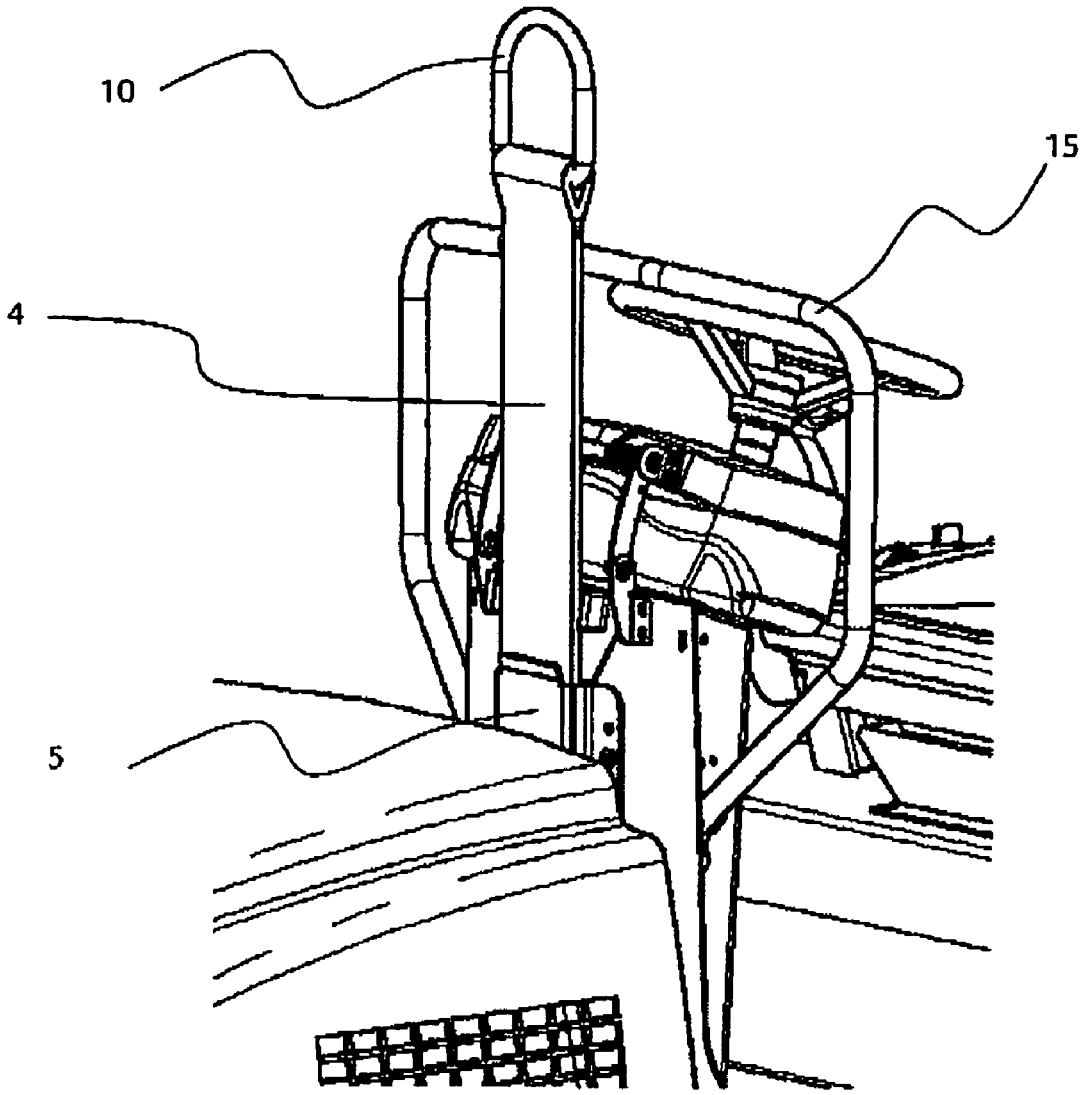
FIG. 4: an enlarged view of the machine with the hoisting mechanism in working position.

FIG. 4 represents the hoisting mechanism in a neutral position. The flexible band 4 is drawn through the guide element 5 and extends through the guide element 5 substantially linearly from the retaining fixture 8 (not represented in FIG. 4) to the suspension element formed by the bracket 10.

In order to change to working position, the suspension bracket is lifted out of the retainer, and the flexible band 4 is extracted in the upward direction until it is completely removed from the intermediate space 12 and extends in a substantially stretched condition between the retaining fixture 8 and the guide element 5.

The guide element 5 serves to prevent the suspended construction machine from tipping or swaying when hoisted. The length of the flexible band 4 is chosen so that when the machine 1 is hoisted it is not damaged by the hoist, particularly so that the control console 6 and climbing bracket 15 are not damaged.

Figure 5:
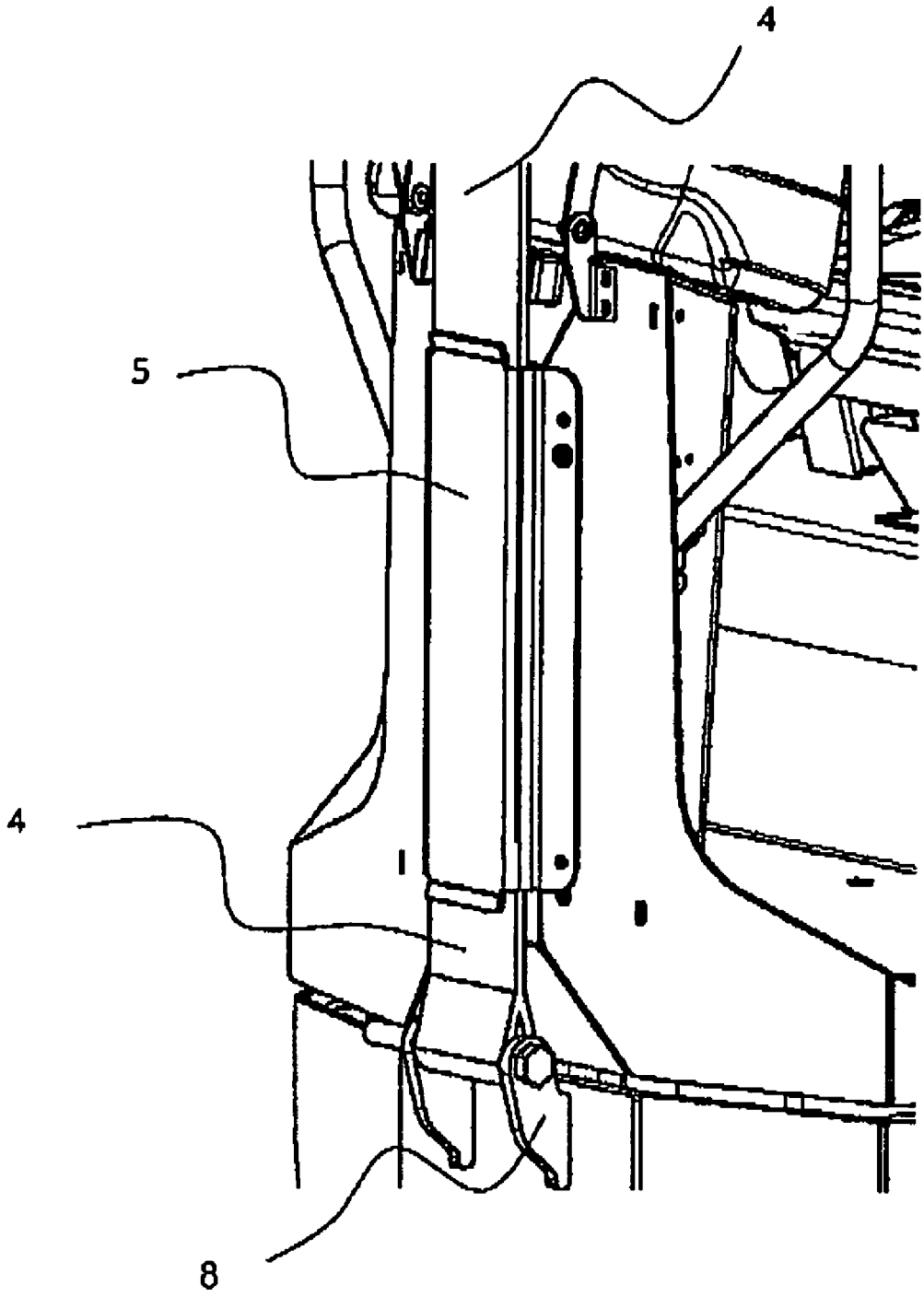
FIG. 5: an enlarged view of the machine with the hoisting mechanism, specifically the guide element of the hoisting mechanism.

FIG. 5 represents the stretched condition of the flexible band 4 between the retaining fixture 8 and the guide element 5 again in the working position.

Figure 6:
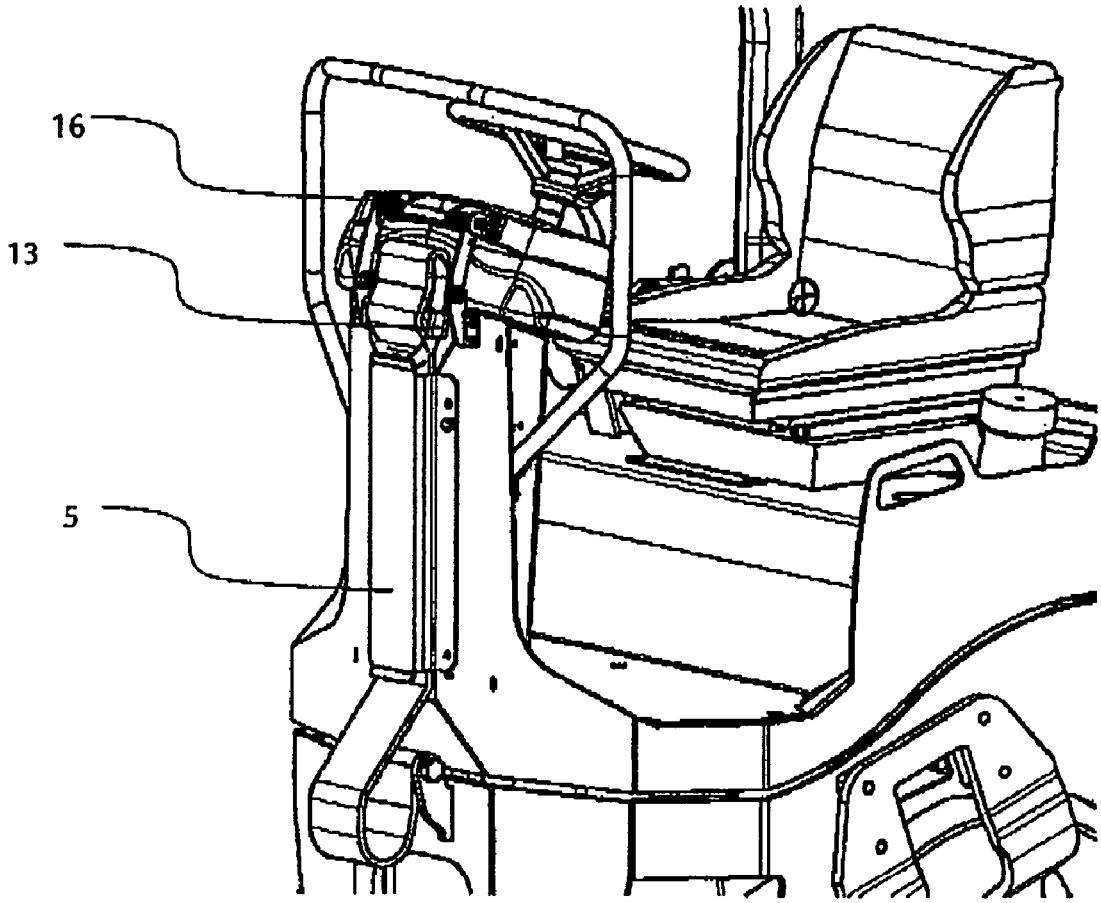
FIG. 6: a view of the machine with the hoisting mechanism in neutral position.

FIG. 6 represents the flexible band 4 in a neutral position in which the bracket 10 is held in the retainer clamp 13. A pivoting cover 16 that is disposed near the retaining clamp 13 is shown in an open condition.

Figure 7:
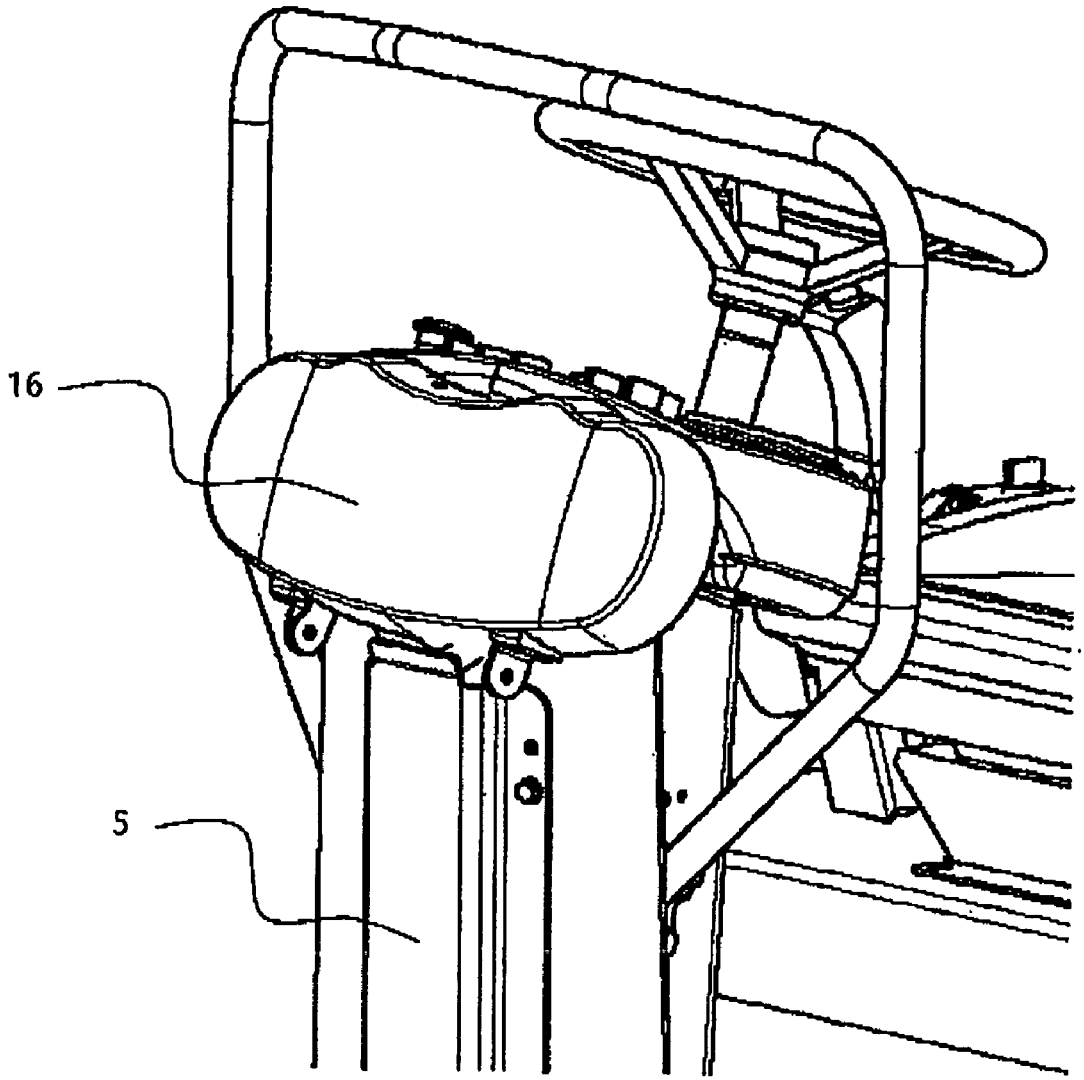
FIG. 7: a view of a cover of the hoisting mechanism for covering the suspension element and the retaining fixture.

In FIG. 7 the cover 16 has been pivoted so that it completely covers the retaining clamp 13, the bracket 10, and the top end of the flexible band 4 and extends substantially to the top end of the guide element 5. This guarantees that the hoisting mechanism 2 is protected from dirt and moisture during operation of the machine, so that the lifetime of the hoisting mechanism 2 is extended.

The utilization of a flexible band 4 as part of a hoisting mechanism 2 serves for preventing vibrations of the machine 1, rattling of the flexible band 4 against components of the machine 1, which generates disruptive noise. [sic]

Through the utilization of a corrosion-resistant band consisting of a plastic or composite fiber material, the same reliability can be guaranteed by means of this type of hoisting mechanism as by fixedly mounted hoisting mechanisms without a flexible band.

The invention claimed is:

1. A machine with a hoisting mechanism for hoisting the machine with the aid of a hoisting apparatus, whereby the hoisting mechanism comprises a flexible bearing element that is fastened at one end in the region of the horizontal center of gravity of the machine and on the other end comprises a suspension capability for connecting to the hoisting apparatus and whereby the flexible bearing element is led in displaceable fashion through a guide element that is disposed substantially vertically above the horizontal center of gravity, wherein the flexible bearing element can be moved into a neutral position in which the flexible bearing element is pushed through the guide element in the direction of the center of gravity until the suspension element is located near a top end of the guide element and a working position in which the flexible bearing element is drawn up so that it extends through the guide element from the center of gravity in a substantially stretched condition.

2. A machine according to claim 1, whereby the guide element (5) is formed by a bracket.

3. A machine according to claim 1, whereby the guide element is formed by a channel.

4. A machine according to claim 1, whereby the guide element comprises an outwardly curved portion at least at one end in order to reduce the abrasion of the flexible bearing element led through it.

5. A machine according to claim 1, whereby an inner cross-section of the guide element is adapted to a cross-section of the flexible bearing element so that the flexible bearing element cannot twist in the guide element.

6. A machine according to claim 1, whereby the hoisting mechanism comprises a retaining fixture that is attached in the region of the horizontal center of gravity of the machine, whereby one end of the flexible bearing element is connected to the frame by means of an attached connection element.

7. A machine according to claim 1, whereby the flexible bearing element takes the form of a band.

8. A machine according to claim 1, whereby the flexible bearing element is corrosion-resistant.

9. A machine according to claim 1, whereby the flexible bearing element comprises a plastic or composite fiber material.

10. A machine with a hoisting mechanism for hoisting the machine with the aid of a hoisting apparatus, whereby the hoisting mechanism comprises a flexible bearing element that is fastened at one end in the region of the horizontal center of gravity of the machine and on the other end comprises a suspension capability for connecting to the hoisting apparatus, whereby the suspension element is constructed as a bracket, grommet, or hook, whereby the bracket is held at the flexible bearing element, a retainer being provided near the top end of the guide element in order to hold the suspension mechanism when in the neutral position.

11. A machine according to claim 10, whereby the retainer is designed to hold the suspension mechanism in the retainer in a downwardly pivoted condition in the neutral position.

12. A machine according to claim 10, whereby a cover is provided in order to cover the suspension element that is held in the retainer in the neutral position, and to remove the suspension element in order to shift into the working position.

13. A machine according to claim 10, whereby the hoisting mechanism comprises a retaining fixture that is attached in the region of the horizontal center of gravity of the machine, whereby one end of the flexible bearing element is connected to the frame by means of an attached connection element.

14. A machine according to claim 10, whereby the flexible bearing element takes the form of a band.

15. A machine according to claim 10, whereby the flexible bearing element is corrosion-resistant.

16. A machine according to claim 10, whereby the flexible bearing element comprises a plastic or composite fiber material.

17. A machine with a hoisting mechanism for hoisting the machine with the aid of a hoisting apparatus, whereby the hoisting mechanism comprises a flexible bearing element that is fastened at one end in the region of the horizontal center of gravity of the machine and on the other end comprises a suspension capability for connecting to the hoisting apparatus, whereby the hoisting mechanism comprises a retaining fixture that is attached in the region of the horizontal center of gravity of the machine, whereby the flexible bearing element comprises a loop at one end, and the retaining fixture comprises two eyes through which a bolt can be inserted so that it extends through the loop.

* * * * *